United States Patent [19]

Izumi

[11] 4,350,025

[45] Sep. 21, 1982

[54] REFRIGERANT EVAPORATOR

[75] Inventor: Masao Izumi, Fujisawa, Japan

[73] Assignee: Nissan Motor Company, Limited, Yokohama, Japan

[21] Appl. No.: 251,100

[22] Filed: Apr. 6, 1981

[30] Foreign Application Priority Data

Apr. 18, 1980 [JP] Japan ..... 55-51766[U]

[51] Int. Cl.[3] ..... F25D 21/14

[52] U.S. Cl. ..... 62/285; 62/515

[58] Field of Search ..... 62/272, 285, 511, 515; 165/110, 111

[56] References Cited

U.S. PATENT DOCUMENTS 2,983,115 5/1961 Caswell ..... 62/515
3,025,685 3/1962 Whitlow ..... 62/515
3,587,730 6/1971 Milton ..... 165/110
4,216,820 8/1980 Andrew ..... 165/110

*Primary Examiner*—Ronald C. Capossela

[57] ABSTRACT

A refrigerant evaporator for use in, for example, an air conditioning system including a fan, blower or the like adapted to establish a flow of air through the evaporator comprises a serpentine-anfractuous evaporator tube and fins attached to the external surfaces of the tube and is characterized by the provision of a ridge wall secured to or integral with a leeward end wall of the evaporator tube and configured to form grooves to collect therein the drops of water condensate which are produced on the surfaces of the tube and fins and which are forced to flow on these surfaces toward the leeward end of the evaporator under the influence of the flow of air through the evaporator.

8 Claims, 12 Drawing Figures

REFRIGERANT EVAPORATOR

FIELD OF THE INVENTION

The present invention relates to a refrigerant evaporator and in particular to a refrigerant evaporator for use in, for example, an air conditioning system.

DESCRIPTION OF THE PRIOR ART

In a prior-art evaporator arrangement illustrated in FIGS. 1 and 2 of the drawings, a refrigerant is continuously fed in a liquid state through a high-pressure pipe 1 and is supplied past an expansion valve 2 and through a refrigerant inlet pipe 3 to a refrigerant evaporator 4. In the evaporator 4, the liquid refrigerant is changed into a gas, which is discharged from the evaporator 4 by way of a refrigerant outlet pipe 5.

The evaporator 4 is composed largely of a serpentine-anfractuous evaporator tube 6 and a number of corrugated fins 7. As will be seen from FIG. 2, the evaporator tube 6 has a multichannel internal construction formed with a number of parallel channels 8 through which the refrigerant is to circulate from the inlet pipe 3 to the outlet pipe 5.

A flow of air is established from one side to the other side of the evaporator 4 as indicated by arrows "A" in FIGS. 1 and 2 so that the fins 7 are constantly contacted by streams of air. The refrigerant supplied in a liquid state to the evaporator tube 6 is caused to change into a gas in each of the channels 8 in the tube 6 and thereby absorbs heat of evaporation from the air flowing on the external surfaces of the tube 6 and the exposed surfaces of the fins 7.

As a result of the exchange of heat between the refrigerant and air thus passed through the evaporator tube 6, the moisture contained in the air contacted by the tube 6 and fins 7 is condensed into drops of water condensate on the surfaces of the tube and fins, as indicated by 9 in FIG. 2. As will be seen more clearly from the schematic illustration of FIG. 3, the drops of water condensate 9 are forced to flow on the surfaces of the tube 6 and fins 7 toward the leeward end of the evaporator 4 under the influence of the flow of air "A".

The evaporator tube 6 has at each of its leeward ends an arcuately curved or rectangularly cornered end face as indicated by numeral 10 in FIGS. 2 and 3. For this reason, the drops of water condensate 9 forced to flow on the surfaces of the tube 6 and fins 7 are ultimately caused to spatter from the leeward end of the tube 6 by the flow of air "A", as will be seen from FIG. 3 and further from FIG. 4A. To collect the drops of water condensate 9 thus splashed from the refrigerant evaporator 4, it has been proposed and put into practice to provide a splash collecting net 11 at the rear of the leeward end of the evaporator 4 as shown in FIG. 3 and further in FIG. 4B. The net 11 is, however, not only satisfactory as splash collecting means but constitutes an obstacle to the flow of air and reduces the effective flow rate of air through the evaporator 4.

BRIEF DESCRIPTION OF THE OBJECT

It is therefore an object of the present invention to provide an improved refrigerant evaporator capable of collecting drops of water condensate without recourse to the provision of such a net.

SUMMARY OF THE INVENTION

In accordance with the present invention, there is provided a refrigerant evaporator for use with air-flow inducing means operative to establish a flow of air in a predetermined direction through the evaporator so that the evaporator has windward and leeward ends in the predetermined direction, comprising an evaporator tube having a longitudinal direction substantially at right angles to the above mentioned predetermined direction and a serpentine-anfractuous cross section in the longitudinal direction of the tube, the evaporator tube having a plurality of parallel portions spaced apart from each other and having formed therebetween gaps through which the aforesaid flow of air is to pass in the above mentioned predetermined direction, and a plurality of fins each secured to and intervening between neighboring two of the parallel portions of the tube, wherein the evaporator tube has at the leeward end of the evaporator an end wall and a ridge wall projecting in a leeward direction from the end wall and forming along the end wall a pair of grooves which are opposite to each other across the ridge wall. The ridge wall of the evaporator tube may comprise a rib portion projecting in the above mentioned leeward direction from the end wall of the evaporator tube, and a pair of wing portions projecting in opposite directions from the rib portion and spaced apart from the end wall of the tube for forming each of the above mentioned grooves between the end wall and each of the wing portions.

BRIEF DESCRIPTION OF THE DRAWINGS

The features and advantages of a refrigerant evaporator proposed by the present invention will be understood from the following description taken in conjunction with the accompanying drawings, in which like reference numerals designate corresponding or similar members, elements and units and in which.

DESCRIPTION OF THE EMBODIMENTS

Figure 5:
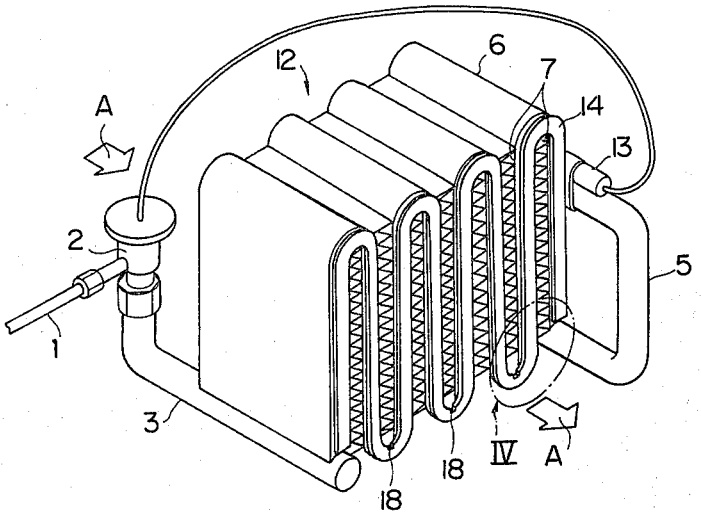
FIG. 5 is a perspective view showing an evaporator arrangement including an embodiment of a refrigerant evaporator according to the present invention.
Figure 6:
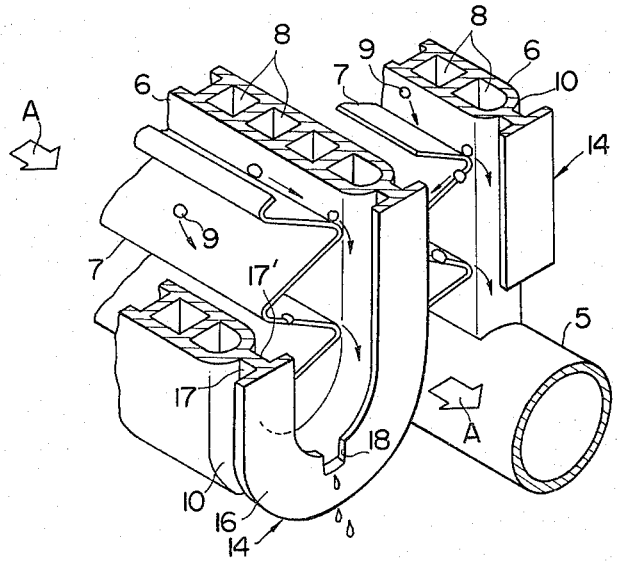
FIG. 6 is a partially cut-away perspective view showing, to an enlarged scale, a portion of the refrigerant evaporator in the evaporator arrangement illustrated in FIG. 5, the portion of the evaporator being indicated by IV in FIG. 5.

Referring to FIGS. 5 and 6 of the drawings, a refrigerant evaporator embodying the present invention, now designated in its entirety by reference numeral 12, is assumed to form part of an air conditioning system which further comprises a high-pressure pipe 1 leading from, for example, a refrigerant condenser (not shown) and terminating in an expansion valve 2. The expansion valve 2 intervenes between the high-pressure pipe 1 and a refrigerant inlet pipe 3 leading to the refrigerant evaporator 12. The evaporator 12 in turn intervenes between the refrigerant inlet pipe 3 and a refrigerant outlet pipe 5 which communicates with the above mentioned refrigerant condenser through, for example, a suitable motor-driven or engine-driven refrigerant compressor (not shown). The refrigerant outlet pipe 5 is shown provided with a temperature-sensitive tube 13 for controlling the expansion valve 2.

Figure 1:
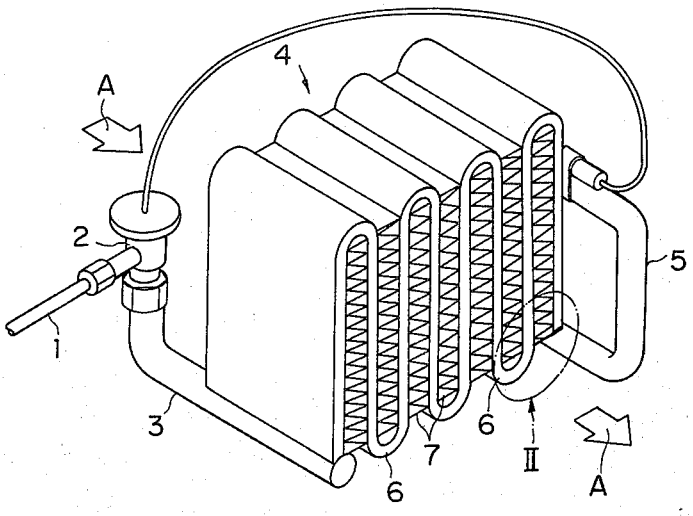
FIG. 1 PRIOR ART
FIG. 1 is a perspective view showing an evaporator arrangement including a known refrigerant evaporator.
Figure 2:
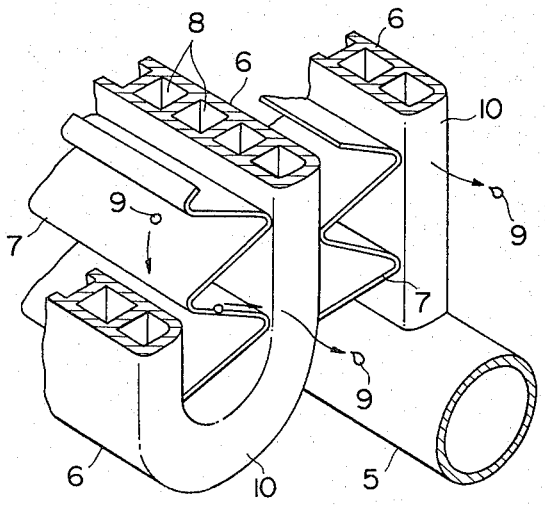
FIG. 2 PRIOR ART
FIG. 2 is a partially cut-away perspective view showing, to an enlarged scale, a portion of the evaporator in the evaporator arrangement illustrated in FIG. 1, the portion being indicated by II in FIG. 1.

Similarly to the prior-art refrigerant evaporator 4 described with reference to FIGS. 1 and 2, the refrigerant evaporator 12 embodying the present invention is largely composed of an evaporator tube 6 and a number of fins 7. The evaporator tube 6 has a serpentine-anfractuous cross section in a longitudinal direction of the tube 6 and, thus, consists of a plurality of parallel portions spaced apart from each other in the longitudinal direction of the tube and forming gaps therebetween and a plurality of U-shaped curved portions each merging with neighboring two of the parallel portions. The U-shaped curved portions are curved alternately in opposite directions and, when the evaporator tube 6 is positioned to have its parallel portions extending in vertical directions as shown in FIGS. 5 and 6, consist of upwardly curved upper portions and downwardly curved lower portions. The evaporator tube 6 thus constructed externally has a multichannel internal construction and is formed with a plurality of discrete channels 8 which extend in parallel with each other between the refrigerant inlet and outlet pipes 3 and 5. On the other hand, each of the fins 7 has a corrugated configuration and structurally intervenes between neighboring two of the above mentioned parallel portions of the evaporator tube 6. More specifically, each of the fins 7 has a number of parallel ridges projecting in alternately opposite directions and is connected along one set of ridges to the external surface of one of neighboring two of the parallel portions of the tube 6 and along the other set of ridges to the external surface of the other of the neighboring two parallel portions of the tube 6, as will be clearly seen from FIG. 6.

The refrigerant evaporator 12 thus constructed is provided in combination with suitable air-flow inducing means such as a fan, blower or the like (not shown). The air-flow inducing means is arranged to be operative to establish a continuous flow of air from one side to the other side of the evaporator 12 through the gaps between the individual parallel portions of the evaporator tube 6, as indicated by arrows "A" in FIGS. 5 and 6. Thus, the evaporator 12 has windward and leeward ends on both sides of the evaporator. The evaporator tube 6 has at the leeward end of the evaporator 12 an end wall 10 extending in serpentine-anfractuous form in a longitudinal direction of the tube 6 and having an arcuately curved or substantially flat cross section as will be seen from FIG. 6. The end wall 10 forms part of the evaporator tube 6 and, accordingly, has parallel portions spaced apart from each other in the longitudinal direction of the tube 6 and U-shaped curved portions each merging into neighboring two of the parallel portions.

In the refrigerant evaporator 12 embodying the present invention, the evaporator tube 6 configured as hereinbefore described further has a ridge wall 14 projecting in a leeward direction from the above mentioned end wall 10 and extending in serpentine-anfractuous form along the end wall 10 in a longitudinal direction of the evaporator 12. As will be seen more clearly from FIG. 7 of the drawings, the ridge wall 14 of the evaporator tube 6 consists of rib portion 15 secured to or integral with the end wall 10 of the tube 6 and projecting in a leeward direction from the end wall, and a pair of wing portions 16 and 16′ projecting in opposite directions from the rib portion 15. The wing portions 16 and 16′ are spaced apart from the outer face of the end wall 10 and form on both sides of the rib portion 15 a pair of grooves 17 and 17′ between the outer face of the end wall 10 and the inner face of the wing portions 16 and 16′. The ridge wall 14 may be formed as an integral portion of the evaporator tube 6 or may be constructed separately of the evaporator tube 6 and secured to the end wall 10 of the tube 6.

Figure 7:
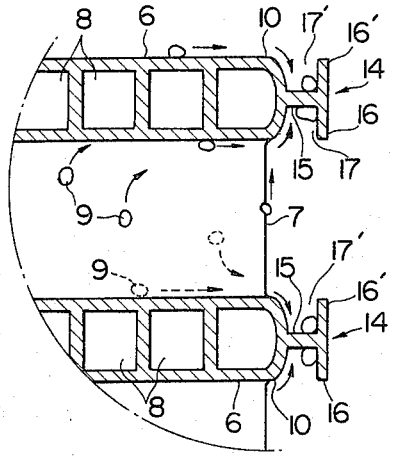
FIG. 7 is a horizontal cross sectional view of the portion of the refrigerant evaporator illustrated in FIG. 6.

In the embodiment of the refrigerant evaporator 12 illustrated in FIGS. 5 to 7, furthermore, the evaporator tube 6 is assumed, by way of example, as being positioned to have its parallel portions extending in vertical directions so that the ridge wall 14 of the tube 6 has generally U-shaped downwardly curved lower end portions. The ridge wall 14 has formed in each of these lower end portions an upwardly open recess 18 which is contiguous to one of the grooves 17 and 17′ or, more specifically, the groove 17 formed between the end wall 10 and the wing portion 16 projecting upwardly from the rib portion 15 in each of the above mentioned lower end portions of the ridge wall 14, as will be best seen from FIG. 6.

The end wall 10, the ridge wall 14 and accordingly the grooves 17 and 17′ extend each in serpentine-anfractuous form throughout the longitudinal measurement of the evaporator tube 6, viz., between the refrigerant inlet and outlet pipes 3 and 5 as will be seen from FIG. 5.

Figure 3:
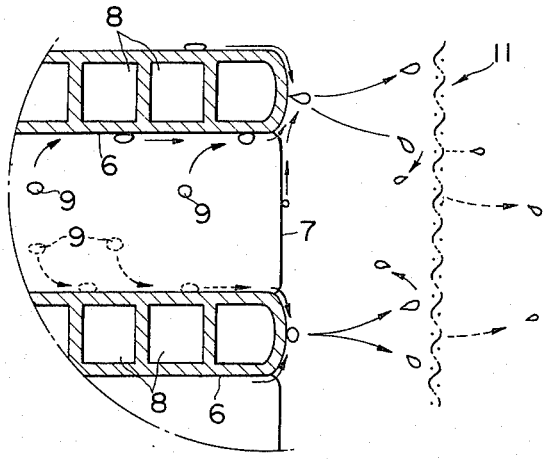
FIG. 3 PRIOR ART
FIG. 3 is a horizontal cross sectional view of the portion of the refrigerant evaporator illustrated in FIG. 2.
Figure 4A:
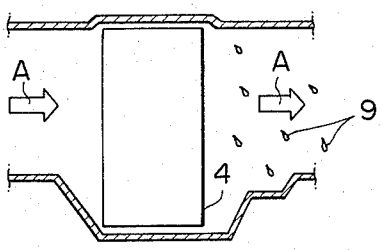
FIG. 4A PRIOR ART
FIG. 4A is a schematic plan view showing conditions in which the refrigerant evaporator illustrated in FIGS. 1 to 3 is in use.
Figure 4B:
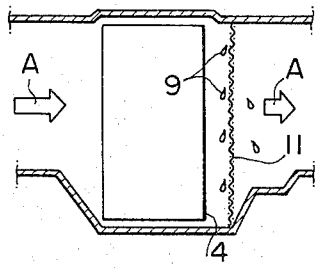
FIG. 4B PRIOR ART
FIG. 4B is a view similar to FIG. 4A but shows conditions in which the known refrigerant evaporator illustrated in FIG. 4A is in use with splash collecting means.

When, now, the refrigerant evaporator 12 constructed and arranged as hereinbefore described is in operation, a continuous flow of air is established through the evaporator 12 by the previously mentioned air-flow inducing means as indicated by the arrows "A" in FIGS. 5 and 6. The flow of the air on the windward side of the evaporator 12 is divided into a plurality of streams which flow through the individual gaps between the streams which flow through the individual gaps between the parallel portions of the evaporator tube 6 and further into a plurality of rugated fins 7 in the gaps. The air thus flowing on and along the external surfaces of the evaporator tube 6 and the exposed surfaces of the fins 7 transfers heat through the tube 6 and fins 7 to the refrigerant flowing through the individual, channels 8 in tube 6 from the refrigerant inlet pipe 3 toward the refrigerant outlet pipe 5 (FIG. 5). As the air being passed through the evaporator 12 is thus cooled, the moisture contained in the air is condensed into drops of water condensate 9 on the surfaces of the tube 6 and fins 7. The drops of water condensate 9 are forced to flow on the surfaces of the tube 6 and fins 7 toward the leeward end of the evaporator 12 under the influence of the flow of air "A" as in the prior-art evaporator arrangement shown in FIGS. 1 to 3. The drops of water condensate deposited on the surfaces of the fins 7 in particular are not only forced to flow toward the leeward end of the evaporator 12 but tend to trickle down the surfaces of the fins 7 to the ridge portions of the fins 7, viz., the external surfaces of the tube 6. The drops of water condensate thus produced on the surfaces of the tube 6 and fins 7 are finally caused to enter the grooves 17 and 17' past the end wall 10 of the tube 6 and trickle down the surfaces of the rib and wing portions of the ridge wall 14. The water condensate directed into one of the grooves 17 and 17', a viz., the groove 17 formed by the wing portion 16 which projects upwardly in each of the previously mentioned lower end portions of the ridge wall 14 reaches bottom portions of the groove 17 and collects in the bottom portions of the grooves 17 until the water overflows through each of the recesses 18 in the ridge wall 14. On the other hand, the water condensate which has entered the groove 17' formed by the wing portion 16' which projects downwardly in each of the lower end portions of the ridge wall 14 reaches the bottom portions of the groove 17' and is allowed to fall in drops therefrom.

Figure 8:
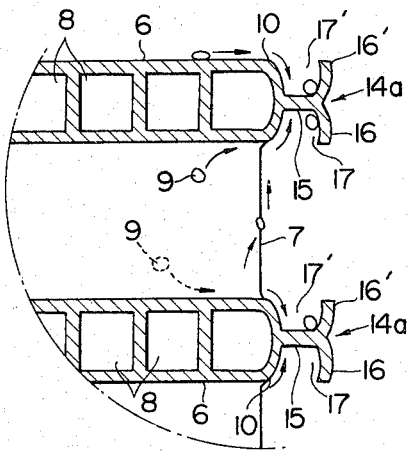
FIGS. 8, 9 and 10 are views similar to FIG. 7 but shows portions of some modifications of the embodiment illustrated in FIGS. 6 and 7.
Figure 9:
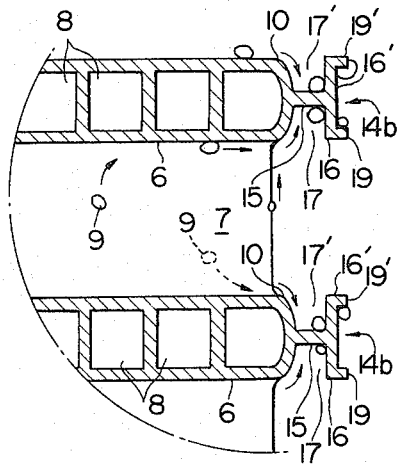
Figure 10:
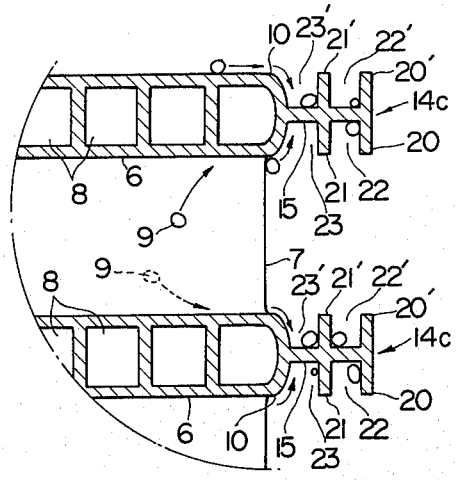

FIGS. 8, 9 and 10 illustrate the cross sectional configurations of some modifications of the ridge wall 14 provided in the hereinbefore described embodiment.

In FIG. 8, a ridge wall **14*a* is shown configured essentially similarly to the ridge wall 14 and thus composed of a rib portion 15 secured to or integral with the end wall 10 of the evaporator tube 6 and a pair of wing portions 16 and 16' projecting in opposite directions from the rib portion 15 and forming grooves 17 and 17' between the end wall 10 and the inner faces of the wing portions 16 and 16', respectively. While the wing portions 16 and 16' of the ridge wall 14 of the hereinbefore described embodiment have substantially flat inner and outer faces as will be best seen from FIG. 7, each of the wing portions 16 and 16' of the ridge wall 14*a* has a cross section which is arcuately concave toward the end wall 10 of the evaporator tube 6. The configuration of the ridge wall 14*a* illustrated in FIG. 8 is adapted to collect drops of water condensate more reliably than the ridge wall 14 shown in FIG. 7**.

Turning to FIG. 9, a ridge wall, now designated by **14*b* is also configured basically similarly to the ridge wall 14 shown in FIG. 7 and has a rib portion 15 secured to or intergral with the end wall 10 of the evaporator tube 6 and a pair of wing portions 16 and 16' forming grooves 17 and 17' between the end wall 10 and the wing portions 16 and 16', respectively. The ridge wall 14*b* shown in FIG. 9 further has a pair of lug portions 19 and 19' longitudinally extending along the lengthwise extending ends of the wing portions 16 and 16' and projecting away from the end wall 10 of the evaporator tube 6. The lug portions 19 and 19' are spaced apart substantially in parallel from each other and form therebetween a shallow groove extending throughout the length of the ridge wall 14*b*. The ridge wall 14*b* thus configured is capable of retaining drops of water condensate not only in the grooves 17 and 17' but in the groove between the lug portions 19 and 19' and is adapted to reliably preclude drops of water condensate from being caused to spatter from the ridge wall 14*b***.

FIG. 10 shows a ridge wall **14*c* which comprises a rib portion 15 secured to or integral with the end wall 10 of the evaporator tube 6, a pair of first or outer wing portions 20 and 20' projecting in opposite directions from the rib portion 15 and spaced apart from the end wall 10, and a pair of second or inner wing portions 21 and 21' projecting in opposite directions from the rib portions 15 and intervening between the end wall 10 of the evaporator tube 6 and the outer wing portions 20 and 20', respectively. The outer wing portions 20 and 20' are spaced apart substantially in parallel from the inner wing portions 21 and 21', respectively, and form therebetween grooves 22 and 22' located on both sides of the rib portion 15. Likewise, the inner wing portions 21 and 21' are spaced apart from the end wall 10 of the evaporator tube 6 and form therebetween grooves 23 and 23', respectively, which are located on both sides of the rib portion 15. Thus, the ridge wall 14*c* shown in FIG. 10 is capable of collecting drops of water condensate not only in the grooves 23 and 23' adjacent the end wall 10 of the evaporator tube 6 but in the grooves 22 and 22' between the wing portions 20 and 20' and the wing portions 21 and 21'**, respectively, thereby retaining drops of water condensate reliably.

Figure 11:
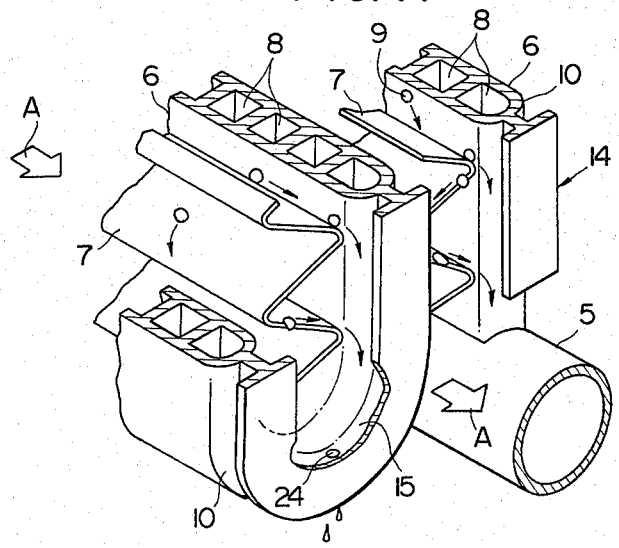
FIG. 11 is a view similar to FIG. 5 but shows another embodiment of the refrigerant evaporator according to the present invention.

As an alternative to the recess 18 formed in each of the lower end portions of the ridge wall 14 in the embodiment of FIGS. 5 to 7, the ridge wall 14 may have formed in each of its lower end portions a drain hole which is open to the grooves 17 and 17' through the rib portion 15 of the wall 14 as indicated at 24 in FIG. 11 of the drawings. Such a hole may also be formed in the rib portion 15 of each of the ridge walls **14*a*, 14*b* and 14*c* shown in FIGS. 7, 8, 9 and 10**, respectively.

What is claimed is:

1. A refrigerant evaporator for use with air-flow inducing means operative to establish a flow of air in a predetermined direction through the evaporator so that the evaporator has windward and leeward ends in said direction, comprising:

an evaporator tube having a longitudinal direction substantially at right angles to said predetermined direction and a serpentine-anfractuous cross section in said longitudinal direction, the evaporator tube having a plurality of parallel portions spaced apart from each other in said longitudinal direction and having formed therebetween gaps through which said flow of air is to pass in said predetermined direction, and a plurality of fins each secured to and intervening between neighboring two of said parallel portions, said evaporator tube having at the leeward end of the evaporator an end wall and a ridge wall projecting in a leeward direction from said end wall and forming along the end wall a pair of grooves which are opposite to each other across ridge wall.

2. A refrigerant evaporator as set forth in claim 1, in which said ridge wall comprises a rib portion projecting from said end wall in said leeward direction, and a pair of wing portions projecting in opposite directions from said rib portion and spaced apart from said end wall for forming each of said grooves between said end wall and each of said wing portions.

3. A refrigerant evaporator as set forth in claim 2, in which said wing portions have substantially flat inner and outer faces.

4. A refrigerant evaporator as set forth in claim 2, in which each of said wing portions has a cross section which is concave toward said end wall.

5. A refrigerant evaporator as set forth in claim 2, in which said ridge wall further comprises a pair of lug portions longitudinally extending along the lengthwise extending ends of said wing portions, respectively, and projecting in cross section away from said end wall.

6. A refrigerant evaporator as set forth in claim 2, in which said ridge wall comprises a pair of first wing portions projecting in opposite directions from said rib portion and spaced part from said end wall, and a pair of second wing portions projecting in opposite directions from said rib portion and intervening between said end wall and said first wing portions, respectively.

7. A refrigerant evaporator as set forth in any one of claims 1 to 6, in which said evaporator tube is positioned to have said parallel portions extending in vertical directions and in which said ridge wall has generally U-shaped downwardly curved lower end portions each formed with an upwardly open recess contiguous to one of said grooves.

8. A refrigerant evaporator as set forth in any one of claims 1 to 6, in which said evaporator tube is positioned to have said parallel portions extending in vertical directions and in which said ridge wall has generally U-shaped downwardly curved lower end portions each formed with a drain hole which is open to said grooves through said rib portion.

* * * * *